US006563405B2

(12) United States Patent
Scott et al.

(10) Patent No.: US 6,563,405 B2
(45) Date of Patent: May 13, 2003

(54) MULTI-RESONATOR FERRITE MICROSTRIP COUPLING FILTER

(75) Inventors: Brian Scott, Santa Rosa, CA (US); John R. Dunseth, Santa Rosa, CA (US); Younes Attaiyan, Santa Rosa, CA (US)

(73) Assignee: Microsource, Inc., Santa Rosa, CA (US)

( * ) Notice: Subject to any disclaimer, the term of this patent is extended or adjusted under 35 U.S.C. 154(b) by 21 days.

(21) Appl. No.: 09/888,218

(22) Filed: Jun. 21, 2001

(65) Prior Publication Data

US 2002/0196105 A1 Dec. 26, 2002

(51) Int. Cl.[7] ..... H01P 1/203
(52) U.S. Cl. ..... 333/205; 333/219.2
(58) Field of Search ..... 333/204, 205, 333/219.2

(56) References Cited

U.S. PATENT DOCUMENTS 3,289,112 A 11/1966 Brown
3,611,197 A 10/1971 Moore et al.
3,740,675 A 6/1973 Moore et al.
4,020,429 A * 4/1977 Bickley ..... 333/205
5,309,127 A 5/1994 Mariani
6,094,588 A * 7/2000 Adam ..... 333/205

* cited by examiner

*Primary Examiner*—Don Le
(74) *Attorney, Agent, or Firm*—Townsend and Townsend and Crew LLP; Kenneth R. Allen

(57) ABSTRACT

A micro-resonator ferrite microstrip coupling filter that has reduced susceptibility to variations in the manufacturing process, as well as from changes due to mechanical or environmental stress, and allows for an assembly process that can be easily automated. The filter comprises bottom and top substrates with conductive ground planes on one side of the substrates and microstrip conductors on the other side of the substrates, with the conductors of both substrates being orthogonal to each other. A circuit block is disposed between the bottom and top substrates such that the circuit block contacts the sides of the substrates containing microstrip conductors. Multiple YIG spheres are inserted into round orifices on the circuit block and positioned between the bottom and top substrates. A magnetic field is applied orthogonally to the conductors.

11 Claims, 2 Drawing Sheets

MULTI-RESONATOR FERRITE MICROSTRIP COUPLING FILTER

BACKGROUND OF THE INVENTION

This invention relates to microwave filters and more particularly to ferrite resonator filters.

The use of ferrite resonator filters is well established in the art. Previous filters consisted of wire loop coupling structures formed in a semicircular shape around ferrite cores orthogonal to each other. When subjected to a bias magnetic field external to both loops, these loops magnetically coupled to the ferrite, which resonated at the magnetically induced frequency. The loops were coupled to each other through the resonance of the common ferrite resonator. In multi-stage filters, this construction method is susceptible to variations in the manufacturing process, as well as from changes induced by mechanical or environmental stress. In the prior art, alignment of the loops was critical to achieve acceptable filter performance. An improved filter structure is desirable to minimize the need for alignment of the loops when the filter is subjected to an external bias magnetic field.

SUMMARY OF THE INVENTION

According to the invention, a ferrite resonator filter for use in connection with an external bias magnetic field provides a simple and reliable multi-resonant microstrip coupling filter structure wherein a metal circuit block is interposed between two substrates such that the circuit block is in contact with the sides of the substrates containing microstrip conductors and wherein the circuit block has orifices for receiving ferrite spheres.

The structure is less susceptible to variations in the manufacturing process, as well as to changes induced by mechanical or environmental stress. Additionally, the present invention allows for an assembly process that can be easily automated, reducing further manufacturing induced variation.

In a first aspect, the present invention provides a filter comprising two substrates made of dielectric material, a metal circuit block and ferrite spheres. The substrates have a conductive ground plane on one face and microstrip conductors on the opposite face. The microstrip conductors are positioned on the substrates so that they are orthogonal to one another and to the external bias magnetic field exerted on the filter. The first end of the first microstrip is connected to a microwave source while the second end is connected to ground. In contrast, the first end of the last microstrip is grounded while the second end of the last microstrip is connected to a microwave load. Both ends of the intermediate microstrip conductors are grounded. The metal circuit block is interposed between the two substrates such that the circuit block is in contact with the sides of the substrates containing microstrip conductors. Additionally, the circuit block has orifices for receiving the ferrite spheres.

In another aspect, the invention provides a filter comprising a single substrate with conductors on both faces of the substrate. Ferrites are then suspended from above or below the substrate.

In another aspect, the invention provides a filter comprising a single substrate with a conductor on the top side and a conductive ground plane on the bottom side. Ferrites are suspended above the substrate.

DESCRIPTION OF THE SPECIFIC EMBODIMENTS

Figure 1:
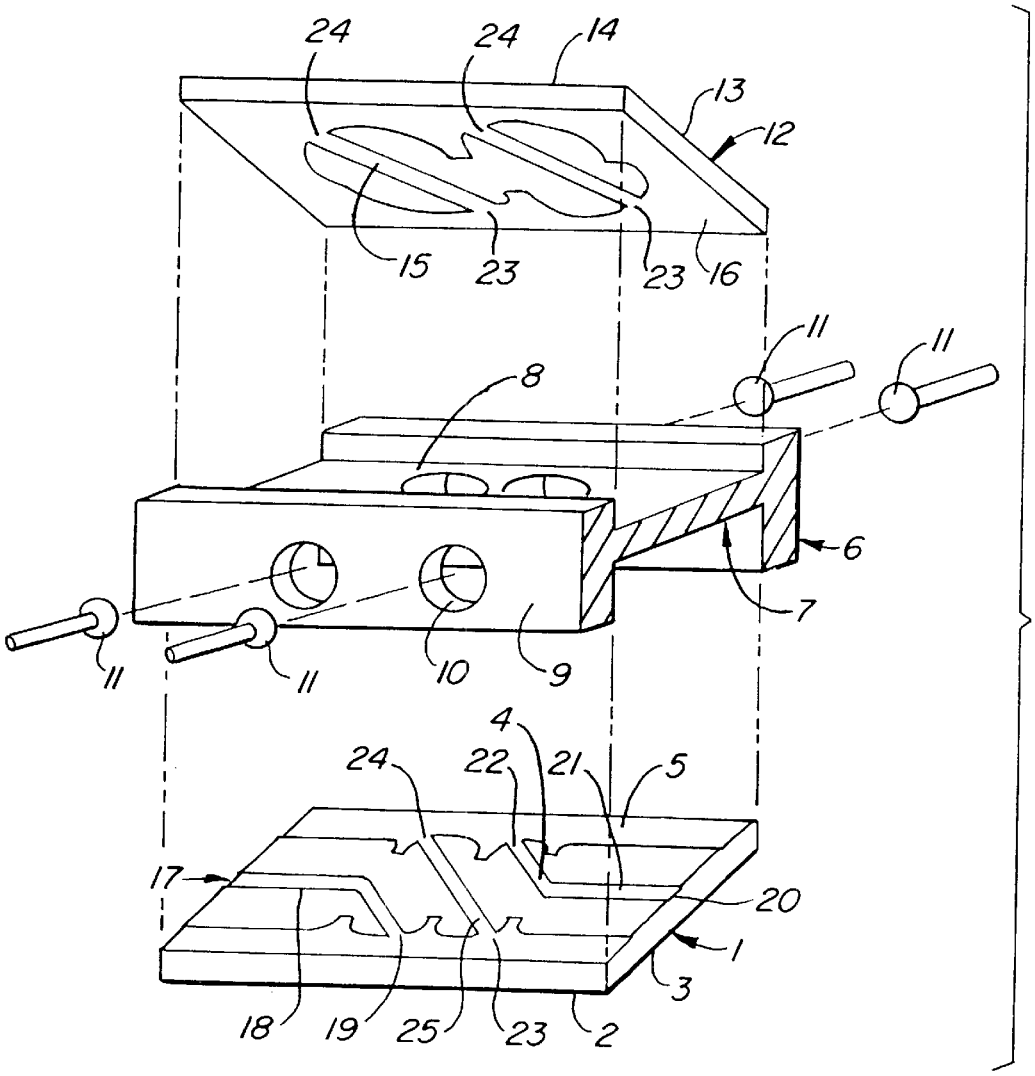
FIG. 1 is an exploded perspective view illustrating one embodiment of the invention.

A multi-resonator ferrite microstrip coupling filter according to the invention that is shown in FIG. 1 includes a bottom substrate 1, preferably of dielectric material. A conductive ground plane 2 covers a first side 3 of the bottom substrate 1 and microstrip conductors 4 cover a second side 5 of the bottom substrate 1. A metal circuit block 6 for providing ground is adhered to the bottom substrate 1 such that the bottom surface 7 of the circuit block 6 is in contact with the second side 5 of the bottom substrate 1.

FIG. 1 also shows a top substrate 12, also preferably of dielectric material, with a conductive ground plane 13 covering the first side 14 of the top substrate 12 and microstrip conductors 15 covering a second side 16 of the top substrate 12. The top substrate 12 is adhered to the metal circuit block 6 such that the top surface 8 of the circuit block 6 is in contact with the second side 16 of the top substrate 12.

In both the bottom and top substrates 1, 12, the first end 17 of the first microstrip conductor 18 is connected to a microwave source, while the second end 19 is grounded. In contrast, the first end 20 of the last microstrip conductor 21 is connected to a microwave load while the second end 22 is grounded. Both ends 23, 24 of intermediate 25 and 15 microstrip conductors are grounded. The microstrip conductors 4, 15 of both substrates 1, 12 are positioned in such a way that the conductors are orthogonal to one another.

Figure 2:
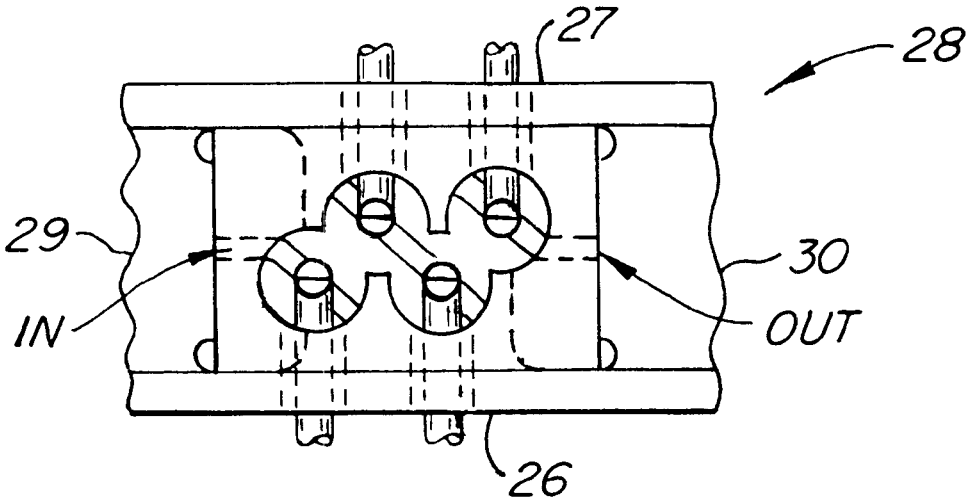
FIG. 2 is a top plan view of one embodiment of the invention.

The sides 9 of the circuit block 6 have multiple circular orifices 10 for receiving YIG spheres 11. YIG spheres 11 are inserted into the orifices 10 and positioned between the second sides 5, 16 of the bottom and top substrates 1, 12. As shown in FIG. 2, the YIG spheres 11 inserted on one side 26 of the coupling filter 28 are parallel to each other but staggered with respect to the YIG spheres 11 inserted on the opposite side 27 of the coupling filter 28.

Figure 3:
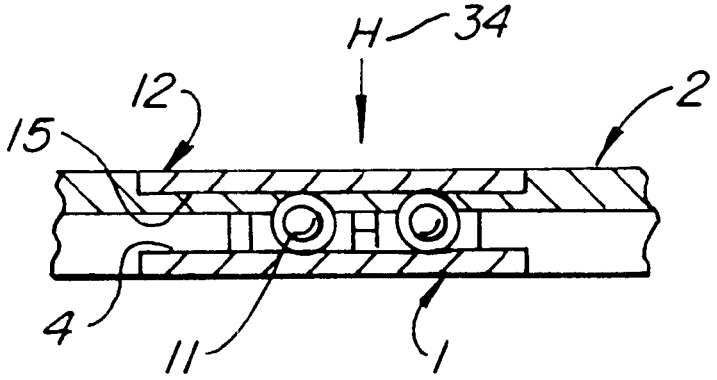
FIG. 3 is a side view of one embodiment of the invention.

As shown in FIG. 2 and FIG. 3, an input signal enters the coupling filter through a first side 29 and an output signal exits the filter through a second side 30. A magnetic field 31 is applied to the filter in a direction orthogonal to the conductors 4, 15 of both substrates 1, 12.

The invention has now been explained with reference to specific embodiments. Other embodiments will be evident to those of ordinary skill in the art. It is therefore not intended that this invention be limited except as indicated by the appended claims.

What is claimed is:

1. A multi-resonant microstrip coupling filter comprising:

a first substrate having a conductive ground plane and microstrip conductors covering opposite sides of the substrate;

a second substrate having a conductive ground plane and microstrip conductors covering opposite sides of the substrate;

a circuit block, interposed between the first substrate and the second substrate, containing multiple orifices on two opposite sides of the block for receiving ferrites, wherein the first substrate side containing microstrip conductors contacts the bottom of the circuit block and the second substrate side containing microstrip conductors contacts the top of the circuit block; and ferrites positioned in the circuit block between the conductors of the substrates.

2. A filter as claimed in claim 1, wherein the substrate is made of dielectric material.

3. A filter as claimed in claim 1, wherein the circuit block is made of metal.

4. A filter as claimed in claim 1, wherein the microstrip conductors of the two substrates are positioned orthogonal to one another.

5. A filter as claimed in claim 4, wherein the conductors of the two substrates are positioned orthogonal to an external bias magnetic field.

6. A filter as claimed in claim 1, wherein the first end of the first miscrostrip conductor is connected to a microwave source.

7. A filter as claimed in claim 6, wherein the second end of the first microstrip conductor is grounded.

8. A filter as claimed in claim 1, wherein the first end of the last microstrip conductor is grounded.

9. A filter as claimed in claim 8, wherein the second end of the last microstrip conductor is connected to a microwave source.

10. A filter as claimed in claim 1, wherein both ends of the intermediate microstrip conductors are grounded.

11. A filter as claimed in claim 1, wherein the ferrites are made of YIG (yttrium, iron, garnet).

* * * * *